United States Patent [19]

Focht

[11] 3,967,763

[45] July 6, 1976

[54] CLIP MOUNTED AEROSOL DISPENSER ACTUATOR

[75] Inventor: John Richard Focht, Yonkers, N.Y.

[73] Assignee: Precision Valve Corporation, Yonkers, N.Y.

[22] Filed: Dec. 20, 1973

[21] Appl. No.: 426,515

Related U.S. Application Data

[63] Continuation of Ser. No. 292,185, Sept. 25, 1972, abandoned, which is a continuation of Ser. No. 86,045, Nov. 2, 1970, abandoned.

[52] U.S. Cl. ..... 222/402.15

[51] Int. Cl.[2] ..... B65D 83/14

[58] Field of Search ..... 222/402.15, 402.13

[56] References Cited

UNITED STATES PATENTS 3,096,002 7/1963 Focht ..... 222/402.15

3,317,092 5/1967 Jurasek ..... 222/402.13

*Primary Examiner*—Robert B. Reeves
*Assistant Examiner*—John P. Shannon
*Attorney, Agent, or Firm*—Davis, Hoxie, Faithfull & Hopgood

[57] ABSTRACT

An actuator for a pressurized aerosol dispenser includes passages which lead from the container mounted valve to a discharge orifice. The actuator provides a lever action having a mechanical advantage to reduce the finger applied force required to open the valve. The pivot or fulcrum of the actuator is in the form of a generally U-shaped resilient clip which grips and rides on the mounting cup bead.

1 Claim, 5 Drawing Figures

FIG.1
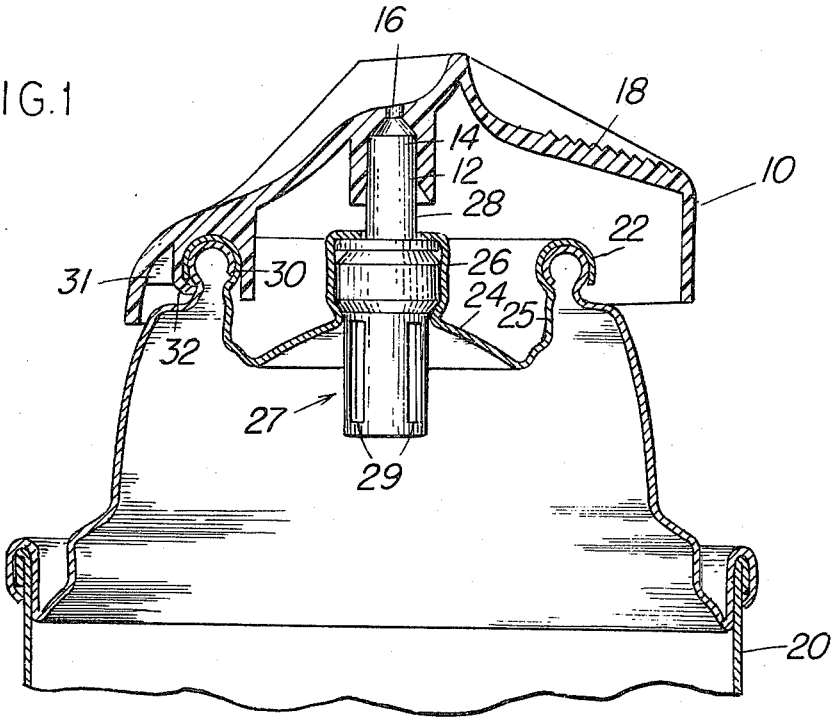
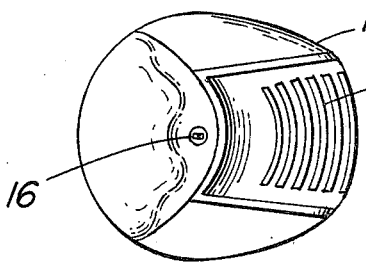
FIG.2
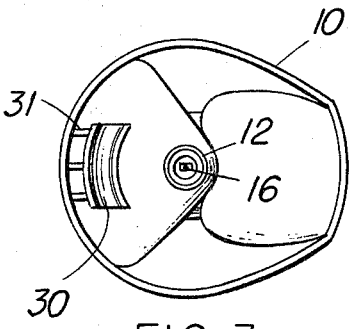
FIG.3
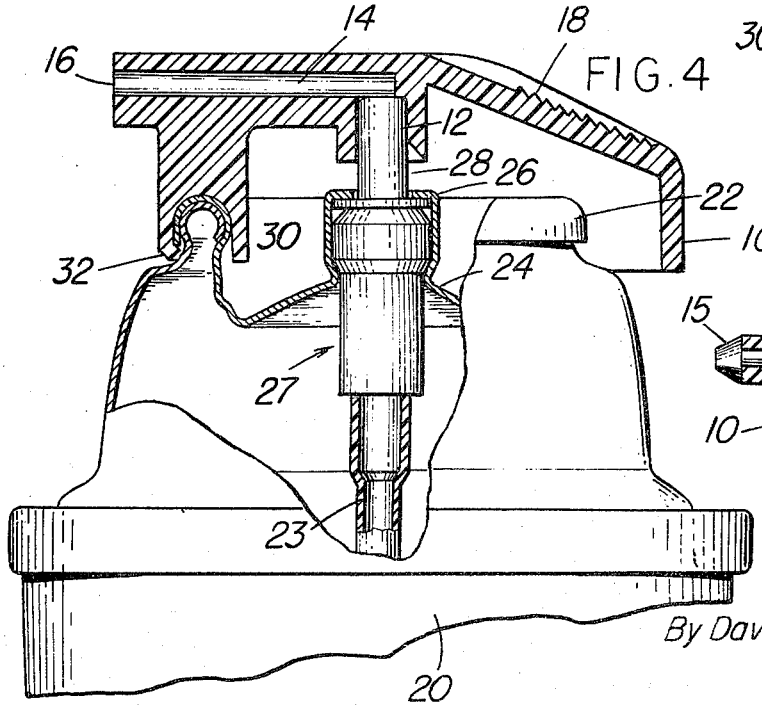
FIG.4
FIG.5
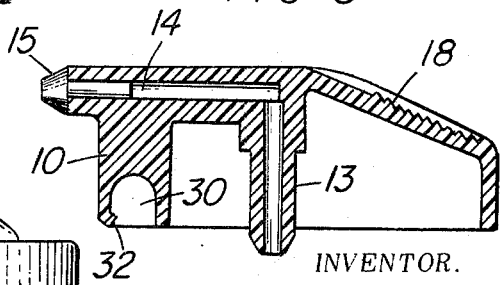
INVENTOR.
John Richard Focht
By Davis, Hoxie, Faithfull & Hapgood
Attorneys

CLIP MOUNTED AEROSOL DISPENSER ACTUATOR

This is a continuation of Ser. No. 292,185, filed Sept. 25, 1972, now abandoned, which is a continuation of Ser. No. 86,045, filed Nov. 2, 1970, now abandoned.

The present invention is concerned with a dispenser head or valve actuator for an aerosol pressurized dispenser. Such an aerosol dispenser is exemplified by U.S. Pat. No. 2,631,814, issued Mar. 17, 1953, "Valve Mechanism for Dispensing Gases and Liquids Under Pressure," Robert H. Abplanalp. Such an aerosol dispenser of this general character generally utilizes a cap or button for depressing the valve stem and for discharging the material passing therethrough in the desired direction.

The purpose of the present invention is to provide an actuator adapted to be associated with the valve stem in such manner that, when the actuator is depressed, it will function through leverage, as hereinafter described, to depress the valve stem throgh a lever action which permits this operation to be carried out with a minimum of applied force.

The present invention is an improvement of Focht patent U.S. Pat. No. 3,096,022 granted July 2, 1963 and assigned to the assignee of the present invention. The actuator described in the aforementioned patent employs a toe diametrically opposite the finger engaging surface, which toe fits beneath the mounting cup bead in an indentation formed during the crimping operation to secure the mounting cup to the container. The toe is thus a fulcrum which provides lever action for actuating the container valve. The association of the toe and the indentation under the mounting cup is susceptable to dislodgement of the actuator under adverse conditions. The present invention is directed to an improved means for an association of such an actuator with the container mounting cup bead which is less subject to dislodgement and is less critical of dimensional tolerances.

More particularly the invention is directed to a dispensing actuator wherein the actuator constitutes a lever fulcrumed on the mounting cup of the dispensing package and having a socket in which the free end of the valve stem is seated. From this socket an outlet passage extends to a spout or other outlet from which the material is discharged. It serves to open the container mounted valve in response to downward finger force applied against a finger receiving surface on the top of the actuator. Product passages internal of the actuator communicate with the product passage of the container mounted valve to convey product from the valve to a discharge orifice in the actuator. The discharge orifice may take any of several forms appropriate to the manner in which the product is to be dispensed. For example, the product may be dispensed as a spray, stream, foam, or ribbon of paste. Spray characteristics may be enhanced by resort to known mechanical break-up means in the product passage of the actuator proximate the discharge orifice. The actuator of the present invention is associated with an aerosol container by means of a clip member on its undersurface, which clip member resiliently embraces a portion of the rounded bead of a conventional aerosol valve mounting cup. The clip member thus permits the actuator to pivotally slip with respect to the mounting cup bead through a small angle to constitute a hinge pivot or fulcrum for providing a lever action to actuate the container mounted valve.

An important feature of this invention resides in the fact that the lever-like actuator is actually pivoted directly on the mounting cup. This feature obviates the necessity of plural hinged pieces or integral pieces connected by a flexible hinge web.

Features of the invention, other than those adverted to, will be apparent from the hereinafter detailed description and appended claims, when read in conjunction with the accompanying drawings.

In the drawings:

FIG. 1 is an elevational view in partial section of a first embodiment of the present invention mounted on a conventional aerosol container;

FIG. 2 is a top view of the actuator according to the first embodiment;

FIG. 3 is a bottom view of the actuator of FIG. 2;

FIG. 4 is an elevational view in partial section of a second embodiment of the present invention mounted on a conventional aerosol container;

FIG. 5 is an elevational view in section of a third embodiment of an actuator in accordance with the present invention.

Referring to the drawings, 20 designates an aerosol container which may be of any suitable material and of any desired shape, commonly a cylindrical metal can. A can of this character is generally provided at its top with a filling opening closed with a mounting cup 24 by a rolled seam bead 22 overlying the lip of the opening and held in place by crimping the lateral wall of the cup laterally so that the crimp 25 firmly and permanently locks the mounting cup to the can and simultaneously forms a hermetic seal between the cup and the can.

The mounting cup is provided with a valve mounting pedestal 26 in which is mounted a valve of any appropriate kind, having a projecting tubular valve stem 28. When the valve stem is depressed, the valve is opened and material within the can flows, under the pressure of the propellant in such can, through the valve stem to be conveyed to a discharge orifice of an actuator member seated on the valve stem 28. The structure thus far described is conventional and may be varied, as will be understood by those skilled in the art.

Referring now to FIGS. 1 through 3, there is illustrated a first embodiment of an actuator in accordance with the present invention. This embodiment is intended for use with products which are to be dispensed downwardly such as aerosol carpet shampoo or floor polish for example. The actuator 10 is a one piece injection molding of an appropriate plastic such as polyethylene, polypropylene, or the like. It is shaped to overlie and conceal the bead 22, which bead is conventionally employed to affix and seal a standard valve mounting cup 24 to the open mouth of an aerosol dispenser container 20. The valve mounting cup 24 includes a valve mounting pedestal portion 26 within which is mounted a dispensing valve 27 having an upstanding hollow vertical valve stem 28 through which the product is conveyed by the pressure within the container 20 when the valve is opened by depression of the valve stem. The valve 27 of the FIG. 1 embodiment has axial entrance slots 29 for the product when the container is inverted. This form of valve insures complete emptying of the contents of the container when inverted. Upstanding valve stem 28 is received within a valve stem receiving socket 12 molded on the underside of the actuator 10. Valve stem receiving socket 12 is in communication with a product passage 14 in the actuator 10. Product passage 14 terminates in a discharge orifice 16 which orifice is of a configuration appropriate to the dispensing pattern desired. In the illustrated embodiment, orifice 16 is rectangular in shape to provide a fan-shaped spray desirable for carpet shampoo application.

The actuator 10 is retained on the container 20 by means of an integrally molded resilient clip 30, best seen in FIG. 3. Clip 30 is in the form of a downwardly opening U-shaped channel, curved in its length to mate with the toroidal shape of the mounting cup bead 22. Clip 30 extends circumferentially of the mounting cup bead 22 through a relatively small sector of arc in the order of 20° to 60°. The U-shape is reentrant or narrows toward the open end by means of a lip 32 to grip the bead 22. The downwardly opening reentrant U-shaped clip 30 is intregal with the actuator body 10. Reinforcements in the form of small ribs 31 may be employed to rigidify the walls of the channel section. The shape of the clip 30 and its lip 32 are such that the actuator will snap fit onto the mounting cup bead 22 and be resiliently retained thereon. The actuator 10 is free to pivot about the circular surface of the toroidal mounting cup bead 22 but is frictionally restrained against revolution about the axis of the valve stem by virtue of the arcuate extent of clip 30. Thus, clip member 30 constitutes a hinge pivot or fulcrum on which the actuator rides to pivot or rock with respect to the container 20.

A finger engaging surface 18 is located diametrically opposite the clip member 30 to provide a lever action having a mechanical advantage for depressing valve stem 28 of the container mounted valve when downward force is applied to the finger engaging surface 18 to accomplish actuation of the valve.

In FIG. 1, the actuator is shown in the position which it occupies when the valve is closed with the valve stem in its outer or rest position. To unseal said valve for the purpose of discharging material from the can 20, force is applied to the finger engaging surface 18 with the result that the valve stem receiving socket 12 is moved toward the container. By virtue of this movement, the valve stem 28 is depressed and material flowing from the can through the valve stem is discharged through the passage 14 of the spout to be discharged through the orifice 16.

As soon as the finger force is released, the spring with which an aerosol valve is generally equipped, together with the pressure of the propellant in the can, will immediately return the actuator to the rest position of FIG. 1 and the dispensing operation will cease.

It will be apparent from the foregoing description that the actuator of this invention operates in the manner of a lever of the second class, pivoted about clip 30, with the entire diametral length of the body member 10 serving as the power arm and the valve stem receiving socket 12 in which the valve stem is seated serving as the point of applied work. The leverage thus provided permits the depressing of the valve stem with a minimum of applied force on the finger engaging surface 18 and serves to provide fine control of the dispensing operation in a simple and efficient manner. The clip 30 provides a smooth, low friction pivot not subject to flexural fatigue.

The embodiment shown in FIG. 4 is similar to that of FIGS. 1 through 3, but differs in being adapted for horizontal rather than vertical discharge and in having a large area discharge orifice 16 appropriate for dispensing a foam product. Since the dispenser assembly of actuator 10 and container 20 will be used in an upright position a conventional product education tube 23 and appropriate valve 27 are illustrated.

The embodiment of FIG. 5 is similar to the previously described embodiments, but differs in having a dependent tubular actuator portion 13 instead of a valve stem receiving socket. The depending tubular portion 13 is adapted to be inserted into those forms of aerosol valves which have no upstanding valve stem and require such a dependency from the actuator for their operation.

FIG. 5 also includes a separate nozzle insert member 15. Such nozzle insert members are described in applicant's copending application Ser. No. 73,537 filed Sept. 18, 1970, now U.S. Pat. No. 3,669,359. Insert member 15 may include internal passages configured to produce swirling action prior to discharge through the orifice 16 to provide a mechanical break-up of the product stream into small spray droplets. Such mechanical break-up means are employed in those aerosol systems wherein the product and propellent are not mutually soluble and consequently do not nebulize readily.

I claim:

1. In a one-piece actuator lever for controlling the dispensing of material from a pressurized container having a top opening closed by a valve mounting cup affixed to the container by a toroidal rolled seam bead of generally circular cross-section, the valve mounting cup including a centrally disposed axially actuable valve with a product outlet passage, the actuator lever being of the type wherein the actuator lever comprises a finger engageable surface at one end of the lever for application of valve actuating force, means on the underside of the lever between the two ends for communication with and frictional retention of the valve product passage and a discharge orifice in communication with the valve product passage, the improvement comprising an integral resilient fulcrum clip at the other end of the lever from the finger engageable surface for pivotally snap-fitting on the bead, said fulcrum clip being in the form of a downwardly opening channel with a reentrant U-shaped configuration which is narrowed toward the opening by a lip for gripping said bead, said channel being curved in its length to mate with the toroidal bead and extending circumferentially of said bead through a relatively small sector of arc from about 20° to about 60° to permit free pivotal movement of the fulcrum clip about the circular surface of the bead for valve actuation while restraining the actuator lever against motion perpendicular to the valve actuation axis, said actuator lever including at least one reinforcement rib to rigidify said channel.

* * * * *